US005156721A

United States Patent [19]

Whewell

[11] Patent Number: 5,156,721

[45] Date of Patent: Oct. 20, 1992

[54] PROCESS FOR EXTRACTION AND CONCENTRATION OF RHODIUM

[76] Inventor: Christopher J. Whewell, 11631 Lyman Rd., Chester, Ohio 44026

[21] Appl. No.: 621,278

[22] Filed: Dec. 3, 1990

[51] Int. Cl.[5] ..... C25F 5/00; C25C 1/00

[52] U.S. Cl. ..... 204/111; 204/146; 205/264

[58] Field of Search ..... 204/47, 109, 111, 146, 204/144; 423/22; 205/264

[56] References Cited

U.S. PATENT DOCUMENTS

| | | | |
|---|---|---|---|
| 1,949,131 | 2/1934 | Shields | 204/47 |
| 2,577,365 | 12/1951 | Reid | 204/47 |
| 3,775,267 | 11/1973 | Yahalom | 204/47 |
| 3,857,763 | 12/1974 | Du Bois | 204/47 |
| 3,902,978 | 9/1975 | Zilske et al. | 204/47 |
| 4,775,452 | 10/1988 | Kuninaga et al. | 204/146 |
| 4,859,445 | 8/1989 | Hirose | 423/462 |

OTHER PUBLICATIONS

The Merck Index, 11th ed., published by Merck & Co., Rahway, N.J., U.S.A. 1989, p. 1302.

Professor H. Remy, "Treatise on Inorganic Chemistry", vol. II. pp. 332-334 (1956).

Georg Brauer, "Handbook of Preparative Inorganic Chemistry," vol. II., 2nd ed., pp. 1585-1590 (1965).

*Primary Examiner*—John Niebling
*Assistant Examiner*—Arun S. Phasge

[57] ABSTRACT

Enclosed herein is a process for extracting and concentrating rhodium metal from its ores or from secondary sources which comprises electrolysis of an aqueous solution of halide ions at a selected pH so as to generate a reactive species and causing metallic rhodium or a rhodium-containing mixture to remain in intimate contact with said solution. Rhodium is dissolved by the solution and is obtained in a concentrated form by either subsequent redeposition on the cathode of the cell or by removal of the electrolyte solution as it becomes enriched in ionic rhodium species. Rhodium is conveniently separated from the cathode of the cell or the electrolyte and purified using techniques known to those skilled in the art. The use of extreme reaction conditions, and the need for on-site storage of certain dangerous chemicals are avoided. As a result, health and environmental risks are diminshed, and plant equipment undergoes less corrosion than a prior art.

According to the present invention, extraction and concentration of rhodium proceeds at a reasonably fast rate using comparatively milder conditions than those in prior art. The starting materials required are safer to store and handle than methods of prior art, and greater economy is realized from increased control of the reactive species. Since the concentration of reactive species is controlled to near its equilibrium level for a given solution temperature, the use of an excess of reagents is avoided, and fume scrubber requirements are proportionately reduced. Rhodium metal concentrates are obtained.

17 Claims, No Drawings

PROCESS FOR EXTRACTION AND CONCENTRATION OF RHODIUM

BACKGROUND OF THE INVENTION

1) TECHNICAL FIELD

The present invention relates to a process for extracting and concentrating elemental rhodium from both primary and secondary sources.

2) BACKGROUND INFORMATION

Heretofore, in order to extract, concentrate, and purify rhodium, several different methods have been employed. Primary sources of rhodium include its ores or any other material which is removed from the Earth and contains rhodium in any one of its native forms. Secondary sources of rhodium include all materials from which rhodium may be refined which have been previously employed for another purpose, e.g. spent catalyst materials, platinum/rhodium thermocouple alloys, electrical contact points, etc. For the recovery of rhodium from primary sources, ores are generally crushed, finely ground and then treated by flotation and magnetic methods to separate sulphide minerals. These sulphides are further separated to yield a nickel concentrate which contains most of the platinum metals. Selective removal of copper followed by controlled oxidation of sulphur leaves behind nickel which contains platinum metals as impurities. This nickel is refined electrolytically, and the platinum metals are recovered from the anode slimes. In the processing of the anode slimes a method is required whereby the platinum metals are converted into solutions of their ions. Once in the form of ionic aqueous solutions, the platinum metals are separated and purified by means known to those skilled in the art.

In the case of secondary sources which contain rhodium, several different methods are available to the refiner for its recovery. The most popular of these methods are described below. The method of recovery chosen depends upon the type of secondary material from which rhodium is being recovered. For example, in the case of certain platinum/rhodium alloy thermocouple wires, it is practical to dissolve the alloys in aqua regia. However, the use of aqua regia becomes less practical when small amounts of rhodium are present in a large amount of insoluble material such as the ceramic support material in the case of automotive catalyst materials.

Since most ores and secondary sources of rhodium contain rhodium as a minor constituent of a mixture, and since it is costly to extract rhodium on a large scale from most mixtures in which it is only present as a minor component, it is of advantage to have at hand a useful method whereby rhodium may be extracted from its sources and rendered into a more concentrated form as an intermediate step prior to final processing. A major burden to this end in the past has been the exceptional difficulty of rendering rhodium soluble to aqueous solution.

One method which is widely used to render rhodium soluble comprises exposing rhodium to sulfuric acid at or near the boiling point of sulfuric acid with or without the aid of other reagents such as sulfur trioxide gas. Another method comprises heating rhodium and a chloride salt of an alkalai or an alkaline Earth metal in an atmosphere of chlorine gas to a high temperature. A third published method comprises the mixing of rhodium with sodium bisulfate and heating to the fusion temperature of the latter until the rhodium is oxidized. Another method has been described by Hirose in U.S. Pat. No. 4,859,445 whereby rhodium is exposed to a solution of hydrochloric acid while highly toxic chlorine gas is bubbled through the solution. Finally, it is known that hot hydrochloric acid dissolves rhodium, but at such a slow rate to be of little practical use.

The present invention provides a method whereby rhodium is dissolved from its sources and concentrated and at the cathode of an electrolytic cell without the need for extreme temperatures, on-site storage of highly hazardous materials, or highly specialized apparatus.

SUMMARY OF THE INVENTION

An object of the present invention is to provide a new and useful process for extracting and concentrating rhodium from its sources.

It is a further object of the invention to rapidly extract and concentrate rhodium using less dangerous starting materials and utilizing milder reaction conditions than prior art.

It is still a further object of the present invention to provide a method to dissolve and concentrate rhodium without the need for on-site storage of free halogens such as chlorine.

The present invention is concerned with electrochemical generation of reactive chemical species in aqueous solution in a galvanic cell which subsequently serve to dissolve rhodium metal from its powders, mixtures, or alloys which are in contact with the solution. Powders, mixtures, or alloys of rhodium include a rhodium element contained in a rhodium alloy which consists of rhodium and a small amount of another platinum group metal as well as a mixture containing rhodium which has been employed in other uses, including recovery residues which contain rhodium, as well as ores which contain rhodium. Following its dissolution, rhodium is concentrated either by electrodeposition at the cathode of the galvanic cell or by removal of the electrolyte solution which contains ionic rhodium species. By proper choice of cathode material, the rhodium which has been concentrated at the cathode is later separated from the cathode material and purified by conventional methods. Sufficient agitation and heating of the solution are employed throughout the process to ensure complete and efficient dissolution and redeposition. Certain chemical additives known to those familiar with electroplating art may or may not be employed to cause the electrodeoposited metal to be less powdery and more adherent to the cathode.

The present invention has the advantage over the method of Hirose (U.S. Pat. No. 4,859,445) for the case when chloride is used as the halide that at the rates of chlorine addition described therein, considerable excess of chlorine is present throughout the process. On a commercial scale, this requires large, efficient fume scrubbers. In the case of the present invention, the burden of fume scrubbing is lessened considerably since usage of excess free halogen is avoided. Also, the present invention requires no on-site facility for storage of halogens (e.g. chlorine), and avoids the dangers and liabilities associated therewith.

DESCRIPTION OF PREFERRED EMBODIMENTS

The reactive chemical species is generated by electrolysis of an aqueous solution containing negatively charged halogen ions (which, for purposes of the present invention are referred to as "halides", the term "halides" where used refers to either chloride, bromide, or iodide ions.) in order to generate free halogen species according to the equation:

$$2X^- \rightarrow X_2 + 2e^-$$

where X may represent chlorine, bromine, or Iodine.

Immediately upon its formation, the free halogen goes on to react with the water present in the solution according to the equation:

$$X_2 + H_2O \rightarrow HX + HOX$$

This last reaction is actually an equilibrium expression, and the concentration of HOX is preferably controlled by adjustment of either pH or current density. Maintaining the concentration of the species in the above reaction to their equilibrium concentrations allows for maximized rates of rhodium dissolution and maximum economy since the highest possible oxidant concentrations are produced at the lowest cost without waste of reagents. For purposes of this invention, the terms oxyhalide ion and oxyhalide species are taken to collectively include both the ionic $OX^-$ radical and the dissolved undissociated form of the corresponding acid HOX, where X represents a halogen. The term "oxyhalide" where used refers to either of or both of these molecular species.

In one preferred form of the invention, when chlorine is employed as the halogen, a slight excess of hydrogen ion is present and the electrical current in the cell is adjusted so that the rate of production of oxyhalide anions is equal to or slightly greater than the rate of consumption of oxyhalide which is caused by the dissolution of rhodium. The dissolution of rhodium proceeds smoothly as long as the solution pH is maintained below about 2 and the temperature is maintained above about 65 degrees C. when chlorine is employed as the halogen. Although the details of the reaction mechanism for rhodium dissolution are unknown, the reaction product of halogen atoms (which are generated by the electrolysis) with water serve as the source of oxidizing agent for the dissolution of rhodium.

Since rhodium is less electropositive than hydrogen, and as long as the cathode of the electrochemical cell used to generate the oxyhalide species is under sufficient cathodic potential, some of the rhodium in solution in the cell will be deposited at the cathode. There it becomes concentrated in the form of a plate and is later separated from the cathode by conventional methods. The anode and cathode may be isolated from each other in different compartments of the electrochemical cell by a filtering membrane which serves to allow solution to pass while retaining particular matter, a closed electrical circuit being maintained through the electrolyte solution. This provision allows for fewer impurities to be introduced in the resulting electroplated material. In one form of the invention the cathode comprises copper. Following rhodium deposition, the copper of the cathode is removed by dissolution in a suitable acid such as nitric acid which leaves behind a residue rich in rhodium which is easily processed to produce a pure rhodium sponge by means known to those skilled in the art.

In another form of the invention, electrolyte solution is removed from the electrolytic cell when its rhodium concentration is at a sufficiently high level for a given set of solution parameters. Rhodium is then recovered from the solution by any one of many convienient methods, for example, reduction with formic acid or zinc metal. Fresh electrolyte solution is added to replace that which was removed, and in this way the process may be operated continuously.

Anodes for use in the galvanic cell of the present invention may consist of any material which serves as a good site for and is not adversly affected by the formation of elemental halogens under conditions of anodic potential in the solutions employed in this invention. It is preferred, however, that the anode is chosen from the group: carbon, platinized titanium, or other noble metal or noble metal alloy-coated substrate such as niobium.

The cathode of the galvanic cell of the present invention may consist of a wide variety of materials which serves as a good substrate for adhesion of rhodium during electrodeposition. The cathode material must also allow for ease of separation of recovered rhodium from itself, and should have a high surface area. Many metals make suitable cathodes for the present invention. Copper and lead are preferred due to their low cost and ease of separation of recovered rhodium.

The electrolytes used in the galvanic cell of the present invention consist essentially of water and: 1) a source of halide ions; 2) a source of hydrogen ions; 3) additives, either organic or inorganic, which improve the adhesion qualities of the deposits obtained, and which may also catalyze rhodium dissolution.

The source of halide ions may come from soluble alkalai metal or alkaline Earth metal halide salts, or the halides of virtually any metal or metalloid which is not electrodepositable under conditions employed in the cell during operation. Preferred sources of halide ions are the sodium halides due to their low cost and ease of availability. The hydrogen halides are available as aqueous solutions and may also be used for the present invention.

The source of hydrogen ion may come from any acid which is sufficiently dissociated in aqueous solution to produce pH levels of about 2 or less when added in small quantities under the conditions employed in the galvanic cell of the present invention. Examples are: the hydrohalic acids (Hydrochloric, hydrobromic, and hydriodic) sulfuric acid, nitric acid, perchloric acid phosphoric acid, etc. Sulfuric acid is preferred since it is widely available, low in cost, and the sulfate ion is rather inert to electrolysis.

Optional additives may be used depending upon the type of material which is being refined. These additives may be either organic or inorganic in nature, and allow for greater integrity of the deposits obtained, probably by a phenomenon known to electrochemists as leveling. Wetting agents, surfactants, organic molecules which contain nitrogen or sulfur atoms, and certain polypeptides have all been employed with varying degrees of success.

The operating temperature of the electrolyte used in the cell is controlled in order to facilitate the efficient dissolution of the rhodium, and also to control the quality of the deposits obtained at the cathode. Temperatures above about 70 degrees C. tend to cause high stress in thick rhodium deposits, and for this reason it is sometimes desirable to keep the temperature below this point when plating to high thicknesses. On the other hand, dissolution of rhodium from the source material is sluggish below about 60 degrees C. and so it is therefore desirable to maintain the solution temperature above this level.

The current density at the cathode is very influential upon the quality of the deposits obtained theron. If the current density at the cathode is above about 25 Amperes per square foot, then it is necesary to have a minimum of about 100 grams of sulfate ion per liter of solution in order to produce reasonably adherent deposits. The free chloride level should also always be kept to a minimum level and especially when operating above 25 ASF.

Since the process is continuous, and the conditions required for rhodium extraction from a given raw rhodium source do vary, the amount of time a given cathode may be plated upon before the deposits become stressed or cracked and no longer adhere to the cathode will also vary. By using a cathode configuration of maximized surface area such as fine wire or metal wools, the plating time for a given cathode is increased.

Agitation of solutions may be accomplished in a variety of ways and this is not as critical as other factors. The main criteria is that the operating current at the cathode should be no more than about 45% of the mass transfer limited current.

The following examples illustrate the invention to those skilled in the art. The examples should be considered as exemplary of the practice of the invention, and not as delimitive thereof. All parts and percentages are by weight.

EXAMPLE I 5.0 grams of rhodium black was suspended in 1 liter of an aqueous solution containing 50 grams of common salt (sodium chloride), 40 grams of phosphoric acid, and 100 grams of sulfuric acid with sufficient stirring. A platinized titanium anode and lead cathode were employed as electrodes with a cathode to anode area ratio of about 1 to 1, and an anode-cathode gap of about 3 inches. The solution was heated to and maintained at 90 degrees centigrade throughout the electrolysis. Three Amperes of electrical current were passed through the solution for 60 minutes after which time the solution was filtered and analyzed for its rhodium content. Analysis showed the solution to contain 0.63 grams per liter of rhodium metal. The process was repeated until the solution showed no reddish color after the electrolysis step was complete. The cathode was dissolved in nitric acid and the residual rhodium was recovered and combined with the rhodium which was recovered from the electrolyte by precipitation with hot formic acid. The total recovered rhodium weighed 4.88 grams.

EXAMPLE II

An electrolyte was made up containing 100 grams per liter of sulfuric acid, 60 grams per liter of sodium chloride and 30 grams per liter of phosphorous acid. A platinized titanium anode and lead cathode were employed as electrodes with an anode to cathode surface area ratio of about 1 to 1. The surface area of the cathode was about 0.9 square feet. The solution was maintained at 90 degrees centigrade during the electrolysis, and the cathode current density was 5 Amperes per square foot. 1000 grams of powdered automotive catalyst material which contained over 98% beta alumina was suspended in the solution with sufficient agitation to suspend most of the solid material. After 2 hours the electrolysis was stopped and the cathode and electrolyte solution were processed in accordance with example I. 2.1 grams of rhodium were recovered.

I claim:

1. A process for extracting and concentrating rhodium from sources wherein rhodium exists in an insoluble state comprising the step of passing an electrical current through an electrolyte solution contained in an electrochemical cell, said electrochemical cell comprising an insoluble anode and at least one cathode wherein no membrane is disposed between said anode and cathode, said electrolyte solution comprising at least 0.1 molar halogen ions and an effective amount of hydrogen ions to maintain the pH below about 2.0, so as to produce and maintain aqueous oxyhalide species while contacting insoluble state rhodium with said electrolyte solution until a portion of the insoluble state rhodium is dissolved and subsequently re-deposited upon the cathode of the cell, thus producing rhodium in a highly concentrated form.

2. A process as set forth in claim 1 and further comprising the step of:

ii) removing the cathode from the electrolyte and separating the rhodium from the cathode substrate by chemical or mechanical means.

3. A process as set forth in claim 1 wherein said halogen ions comprise ions selected from the group consisting of chloride ions, bromide ions, iodide ions, or mixtures thereof.

4. A process as set forth in claim 1 wherein said cathode comprises a metal selected from the group consisting of lead, copper, nickel, mercury, iron, or alloys thereof.

5. A process as set forth in claim 1 wherein said insoluble anode comprises a substrate which is covered with an insoluble coating comprising platinum or other noble metal or noble metal alloy.

6. A process as set forth in claim 5 wherein said insoluble anode comprises platinized titanium.

7. A process as set forth in claim 1 wherein said insoluble anode comprises carbon.

8. A process as set forth in claim 1 wherein the source of the insoluble state rhodium includes spent catalyst materials.

9. A process as set forth in claim 8 wherein said spent catalyst material includes spent automotive catalysts.

10. A proess as set forth in claim 1 wherein the source of the insoluble state rhodium comprises a rhodium ore.

11. A process as set forth in claim 1 wherein the source of the insoluble state rhodium comprises platinum/rhodium thermocouple alloys.

12. A process as set forth in claim 1 wherein the electrolyte contains an effective amount of phosphorous acid for promoting adhesion of the deposited rhodium.

13. A process as set forth in claim 1 wherein the source of said hydrogen ions comprises an acid selected from the group consisting of: hydrochloric, hydrobromic, hydroiodic, or mixtures thereof.

14. A process as set forth in claim 1 wherein the source of said hydrogen ions comprises an acid selected from the group consisting of: sulfuric, nitric, perchloric, phosphoric or mixtures thereof.

15. A process as set forth in claim 1 wherein the temperature of said electrolyte is maintained in the range of about 60 to 100 degrees centigrade.

16. A process as set forth in claim 1 wherein the operating current at the cathode is no more than about 45% of the mass transfer limiting current.

17. A process as set forth in claim 1 and further comprising the steps of:

ii) removing portions of the electrolyte solution from the electrochemical cell as it becomes enriched with soluble rhodium species;

iii) refining the removed portion of electrolyte solution by means known to those skilled in the art to produce pure rhodium sponge.

* * * * *